US012168856B2

(12) United States Patent
De Vos

(10) Patent No.: US 12,168,856 B2
(45) Date of Patent: Dec. 17, 2024

(54) IMPACT-ATTENUATING DEVICE, VEHICLE AND TRAILER COMPRISING AN IMPACT-ATTENUATING DEVICE

(71) Applicant: STUER-EGGHE BVBA, Sint-Niklaas (BE)

(72) Inventor: Adriaan Joris De Vos, Sint-Niklaas (BE)

(73) Assignee: STUER-EGGHE BVBA, Sint-Niklaas (BE)

( * ) Notice: Subject to any disclaimer, the term of this patent is extended or adjusted under 35 U.S.C. 154(b) by 0 days.

(21) Appl. No.: 18/020,545

(22) PCT Filed: Aug. 4, 2021

(86) PCT No.: PCT/IB2021/057150
§ 371 (c)(1),
(2) Date: Feb. 9, 2023

(87) PCT Pub. No.: WO2022/038444
PCT Pub. Date: Feb. 24, 2022

(65) Prior Publication Data

US 2023/0228048 A1 Jul. 20, 2023

(30) Foreign Application Priority Data

Aug. 17, 2020 (BE) ..... 2020/5572

(51) Int. Cl.
*E01F 15/14* (2006.01)

(52) U.S. Cl.
CPC ..... *E01F 15/148* (2013.01)

(58) Field of Classification Search
None
See application file for complete search history.

(56) References Cited

U.S. PATENT DOCUMENTS 5,052,732 A * 10/1991 Oplet ..... E01F 9/662 428/116
5,697,657 A * 12/1997 Unrath, Sr. ..... B60R 19/00 293/133

(Continued)

FOREIGN PATENT DOCUMENTS

EP 0586071 B1 * 3/1996
EP 0903265 A2 3/1999

(Continued)

OTHER PUBLICATIONS

The International Search Report and Written Opinion mailed Oct. 29, 2021, for Application No. PCT/IB2021/057150 (13 pages).

*Primary Examiner* — Thomas B Will
*Assistant Examiner* — Katherine J Chu
(74) *Attorney, Agent, or Firm* — KDW Firm PLLC

(57) ABSTRACT

An impact-attenuating device includes a first energy-absorbing part having at least one first elongate body and at least one corresponding first energy converter to deform the first elongate body in the case of relative movement. A second energy-absorbing part has at least one second elongate body and at least one corresponding second energy converter configured to deform the second elongate body in the case of relative movement. A bumper is coupled to the first energy-absorbing part. The first and second energy-absorbing parts are positionable one behind the other. The first and second energy-absorbing part are mutually coupled such that the at least first and second elongate bodies are deformed at least partially simultaneously by respectively the at least one corresponding first energy converter and the at least one corresponding second energy converter when a vehicle crashes into the bumper.

19 Claims, 11 Drawing Sheets

(56) References Cited

U.S. PATENT DOCUMENTS

| | | | | |
|---|---|---|---|---|
| 7,210,874 | B2 * | 5/2007 | Albritton | E01F 15/146 404/6 |
| 7,871,220 | B2 * | 1/2011 | Albritton | E01F 15/0423 404/6 |
| 10,378,165 | B2 * | 8/2019 | Dyke | E01F 15/0423 |
| 2015/0069771 | A1 * | 3/2015 | Buehler | E01F 15/148 293/118 |
| 2017/0234393 | A1 * | 8/2017 | Degroot | E01F 15/146 256/13.1 |
| 2021/0108383 | A1 * | 4/2021 | Maus | E01F 15/146 |

FOREIGN PATENT DOCUMENTS

| | | | | |
|---|---|---|---|---|
| KR | 20120004200 | U * | 6/2012 | |
| WO | WO-9747495 | A1 * | 12/1997 | B60R 19/00 |
| WO | 2017138809 | A1 | 8/2017 | |

* cited by examiner

IMPACT-ATTENUATING DEVICE, VEHICLE AND TRAILER COMPRISING AN IMPACT-ATTENUATING DEVICE

This application is a national stage filing under 35 U.S.C. 371 of pending International Application No. PCT/IB2021/057150, filed Aug. 4, 2021, which claims priority to Belgian Patent Application No. 2020/5572, filed Aug. 17, 2020, the entirety of which applications are incorporated by reference herein.

FIELD OF THE INVENTION

The present invention relates to an impact-attenuating device. The invention further relates to a vehicle and a trailer comprising an impact-attenuating device.

BACKGROUND

Impact-attenuating devices are used to increase safety on and around a roadway, mainly in the vicinity of roadworks or other temporary or altered traffic situations. The operating principle of impact-attenuating devices is that, when a vehicle collides therewith, they absorb at least part of the kinetic energy of the colliding vehicle, whereby this vehicle can be brought to a standstill in a safe manner. On the one hand an area, such as a roadworks site, is screened off by the impact-attenuating device in this way, and any people present in this area are protected from collisions by vehicles that often approach such areas at excessive speeds. On the other hand, the one or more occupants of the colliding vehicle are protected in that the vehicle is brought to a gradual standstill, which decreases the chances of injury or worse as compared to the event wherein the vehicle comes to an abrupt standstill.

The main function of impact-attenuating devices is therefore to absorb kinetic energy. It is further important for impact-attenuating devices to be easily transportable. This is because they are utilized at different locations, and often have to be able to reach a location quickly. Mobile impact-attenuating devices are known and typically have the option of being transported in compact manner. For the actual purpose of a safe impact attenuation a long impact-attenuating device is however desirable, and these mobile impact-attenuating devices therefore typically consist of separate parts which are disposed one behind the other at the desired location. Such impact-attenuating devices however have the drawback that they absorb kinetic energy in less efficient manner, and are therefore less safe.

SUMMARY OF THE INVENTION

Embodiments of the invention have the object of providing an impact-attenuating device, particularly an impact-attenuating device which can be transported easily and guarantees a high degree of safety. It is a further object of embodiments of the invention to provide an impact-attenuating device which is able to bring a vehicle to a standstill gradually.

A first aspect of the invention relates to an impact-attenuating device comprising a first energy-absorbing part which comprises at least one first elongate body and at least one corresponding first energy converter, wherein the first elongate body and the first energy converter are movable relative to each other and wherein the first energy converter is configured to deform the first elongate body in the case of relative moment. The impact-attenuating device further comprises a second energy-absorbing part which comprises at least one second elongate body and at least one corresponding second energy converter, wherein the second elongate body and the second energy converter are movable relative to each other and wherein the second energy converter is configured to deform the second elongate body in the case of relative movement. The impact-attenuating device further comprises a bumper which is coupled to the first energy-absorbing part. The first and second energy-absorbing part can be positioned substantially one behind the other. The first and second energy-absorbing part are mutually coupled such that the at least first elongate body and the at least second elongate body are deformed at least partially simultaneously by respectively the at least one corresponding first energy converter and the at least one corresponding second energy converter when a colliding vehicle crashes into the bumper.

The impact-attenuating device is based on the inventive insight that, by allowing a simultaneous deformation of the first and second elongate body, a more uniform energy absorption is obtained as compared to known impact-attenuating devices. In other words, by coupling the first and second energy-absorbing part in such a manner in a set-up state a safe impact-attenuating device is provided which can be easily transported.

The first and second energy converters preferably comprise respectively first and second cutting means which are configured to cut respectively the first and second elongate bodies.

In this way part of the kinetic energy of the colliding vehicle is absorbed by means of cutting force.

The first and second energy converters preferably comprise respectively a first and second bending part configured to bend respectively the first and second elongate bodies.

In this way part of the kinetic energy of the colliding vehicle is absorbed by means of bending or deformation of the first and/or second elongate body. An initial part of the kinetic energy which corresponds to an initial (high) speed of the colliding vehicle is preferably absorbed by cutting of the first and/or second elongate body. A remaining part of the kinetic energy, which corresponds to a lower speed of the colliding vehicle, is preferably absorbed by the bending or deformation of the first and/or second elongate body. This is advantageous because the cutting resistance rises sharply when the cutting speed drops below a threshold value whereby a final peak in the deceleration of the colliding vehicle would be caused. Such a final peak has the result that the colliding vehicle comes to an abrupt standstill, which would be detrimental to the safety of the occupants. By combining the cutting of the elongate bodies with the deformation or bending of the elongate bodies the final peak in the deceleration of the colliding vehicle can be avoided. This effect is intensified further in that kinetic energy is also absorbed by friction which occurs during the bending of the first and/or second elongate body, and/or by inertia which occurs when the components of the first and/or second energy-absorbing part are set into motion.

It will be apparent to the skilled person that the different forms of energy absorption, such as cutting and bending, take place during the entire process of bringing the colliding vehicle to a standstill. The different forms of energy absorption thus occur at both low and high speeds. A ratio or distribution at a given moment between these different forms of energy absorption will however differ depending on the energy to be absorbed and so the speed of the colliding vehicle. This ratio at a given moment will change over the course of time as the speed changes, precisely because the different forms of energy absorption depend on the speed in different ways.

The first and second energy-absorbing parts preferably have mutually differing conversion resistances. Conversion resistance is understood to mean the conversion resistance for the same speed. In other words, if the first and second energy-absorbing parts were to convert the kinetic energy of a colliding vehicle with a determined speed independently of each other, the different conversion components such as cutting resistance, deformation resistance, friction and inertia would result in a mutually differing resistance resultant. In practice the first energy-absorbing part will typically be subjected to a higher speed than the second energy-absorbing part, whereby similar forces are absorbed by the two energy-absorbing parts.

In this way the impact-attenuating device can use different resistance components in advantageous manner. This results in a quasi-self-regulating impact-attenuator which filters peaks from the deceleration profile in mechanical manner. In other words, a uniform deceleration is obtained by the diversity of available conversion components in the different energy-absorbing parts and by coupling of the respective energy-absorbing parts, this irrespective of the speed and/or mass of the colliding vehicle.

The first energy-absorbing part preferably has a first deformation resistance and the second energy-absorbing part a second deformation resistance, wherein the first deformation resistance is smaller than the second deformation resistance.

The first and second energy-absorbing parts are preferably mutually coupled by means of a coupling which is configured to partially block relative movement of the first energy-absorbing part and the second energy-absorbing part in a set-up state of the impact-attenuating device. A possible coupling is a lock or sliding lock.

The first energy-absorbing part preferably comprises an interlocking means which is configured on the one hand to block relative movement of the first elongate body and the first energy converter when a force exerted on the interlocking means is smaller than a predetermined threshold value and, on the other hand, to release relative movement of the first elongate body and the first energy converter when the force exerted on the interlocking means is greater than the predetermined threshold value. An example of such an interlocking means comprises one or more shear pins. In this way it is ensured that the energy-absorbing action of the first energy-absorbing part is not used until the impact-attenuating device has been set up and a crash or collision takes place. The impact-attenuating device can thus be transported in a safe manner.

The second energy-absorbing part preferably comprises an interlocking means which is configured on the one hand to block relative movement of the second elongate body and the second energy converter when a force exerted on the interlocking means is smaller than a predetermined threshold value and, on the other hand, to release relative movement of the second elongate body and the second energy converter when the force exerted on the interlocking means is greater than the predetermined threshold value. An example of such an interlocking means is a shear pin. In this way it is ensured that the energy-absorbing action of the second energy-absorbing part is not used until the impact-attenuating device has been set up and a crash or collision takes place. The impact-attenuating device can thus be transported in a safe manner.

The first and second energy converters preferably comprise respectively a first and second guide part which are arranged to guide respectively the first and second elongate bodies in the first and second energy converters.

The first and second energy converters are preferably respectively arranged at an outer end of respectively the first and second elongate bodies. It will however be apparent to the skilled person that the energy converters can also be arranged elsewhere.

The first energy converter is preferably arranged at an outer end of the first elongate body which is directed away from the bumper. It will however be apparent to the skilled person that the first energy converter can also be arranged elsewhere.

The second energy converter is preferably arranged at an outer end of the second elongate body which is directed toward the bumper. It will however be apparent to the skilled person that the second energy converter can also be arranged elsewhere.

The first and/or second cutting means preferably comprise at least two cutting surfaces. It will be apparent to the skilled person that the at least two cutting surfaces are formed by means of one blade, two blades or more blades. The two cutting surfaces are preferably mutually adjacent. The two cutting surfaces are further preferably disposed in an angular configuration, wherein the open legs of the angle are directed toward the elongate body in question. The two cutting surfaces form a cutting surface pair and co-act in order to cut the elongate body in question along a cutting line. It will be apparent to the skilled person that the first and/or second cutting means can comprise a plurality of cutting surface pairs for cutting the elongate body in question along multiple corresponding cutting lines.

The first and/or second cutting means preferably comprise a plurality of cutting surface pairs which are positioned such that they cannot come into contact with the elongate body in question simultaneously.

In this way the force absorption is built up gradually.

The plurality of cutting surface pairs are preferably disposed substantially parallel relative to each other.

The elongate bodies preferably comprise tubular profiles.

The tubular profiles preferably have a substantially rectangular cross-section. The tubular profiles more preferably have a substantially square cross-section. It will however be apparent to the skilled person that the cross-section of the tubular profiles can be substantially round or substantially hexagonal or octagonal. Other cross-sectional shapes are also possible.

The tubular profiles are preferably provided at an outer end thereof with at least one guiding recess. Such a guiding recess is also referred to as slip hole.

When such a guiding recess is encountered, the cutting is interrupted. This provides for a build-up of force over a longer distance and a reduced chance of a pressure surge. A gradually increasing force absorption is therefore achieved in this way.

The first and/or second bending part is preferably configured to bend the respective first and/or second elongate body through an angle of between 45° and 135°, more preferably between 60° and 120°, still more preferably between 70° and 110°, still more preferably between 80° and 100°, and most preferably between 85° and 95°.

The first energy-absorbing part and the second energy-absorbing part are preferably mutually slidable between an extended state, wherein the first and second energy-absorbing parts are placed substantially one behind the other, and a retracted state wherein the first and second energy-absorbing parts are placed substantially adjacently of each other.

The impact-attenuating device preferably comprises a coupling means for coupling to a tilting mechanism, wherein the impact-attenuating device is tiltable between a substantially horizontal operative state and a substantially vertical transport state.

The first energy-absorbing part preferably comprises two first elongate bodies and two corresponding first energy converters, wherein the two first elongate bodies extend substantially parallel relative to each other.

The second energy-absorbing part preferably comprises two, more preferably four, second elongate bodies and two, more preferably four, corresponding second energy converters, wherein the two, more preferably four, second elongate bodies extend substantially parallel relative to each other.

A second aspect of the invention relates to a vehicle and/or trailer comprising an impact-attenuating device.

It will be apparent to the skilled person that the measures and advantages associated with the above described embodiments of the impact-attenuating device according to the first aspect of the invention apply similarly, mutatis mutandis, to a vehicle and/or trailer according to the second aspect of the invention.

A third aspect of the invention relates to the use of an impact-attenuating device according to any one of the foregoing embodiments in protecting a roadway or roadworks site.

It will be apparent to the skilled person that the measures and advantages associated with the above described embodiments of the impact-attenuating device according to the first aspect of the invention apply similarly, mutatis mutandis, to the use of the impact-attenuating device according to the third aspect of the invention.

BRIEF DESCRIPTION OF THE FIGURES

The above stated and other advantageous features and objects of the invention will become more apparent, and the invention better understood, on the basis of the following detailed description when read in combination with the accompanying drawings, in which.

DETAILED EMBODIMENTS

Figure 1A:
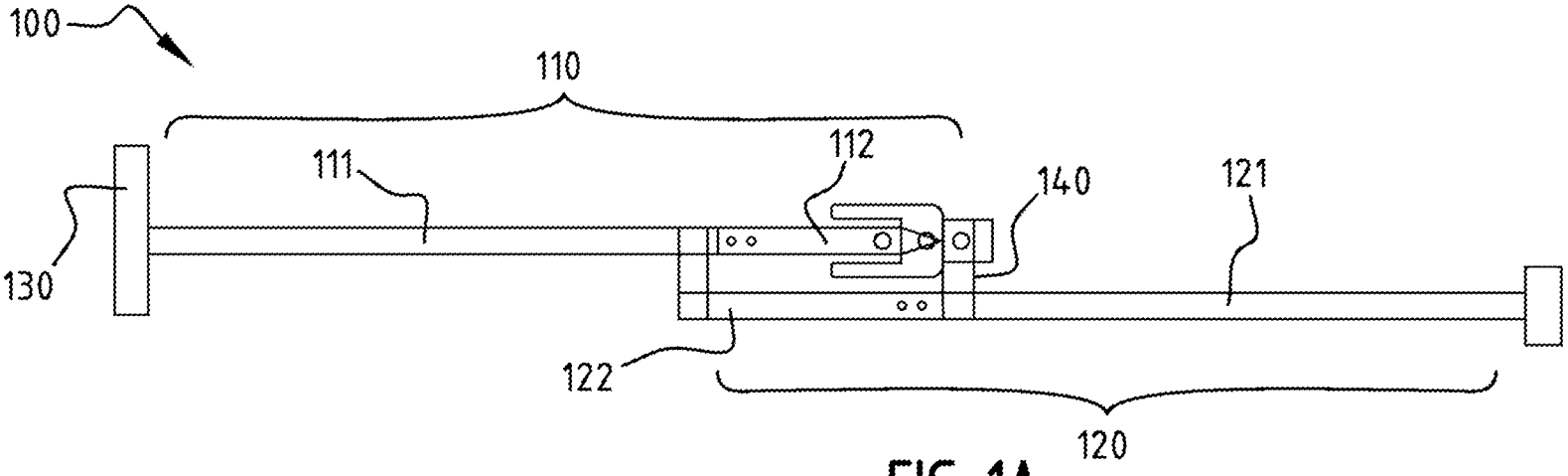
FIG. 1A is a simplified side view of an embodiment of an impact-attenuating device.
Figure 1B:
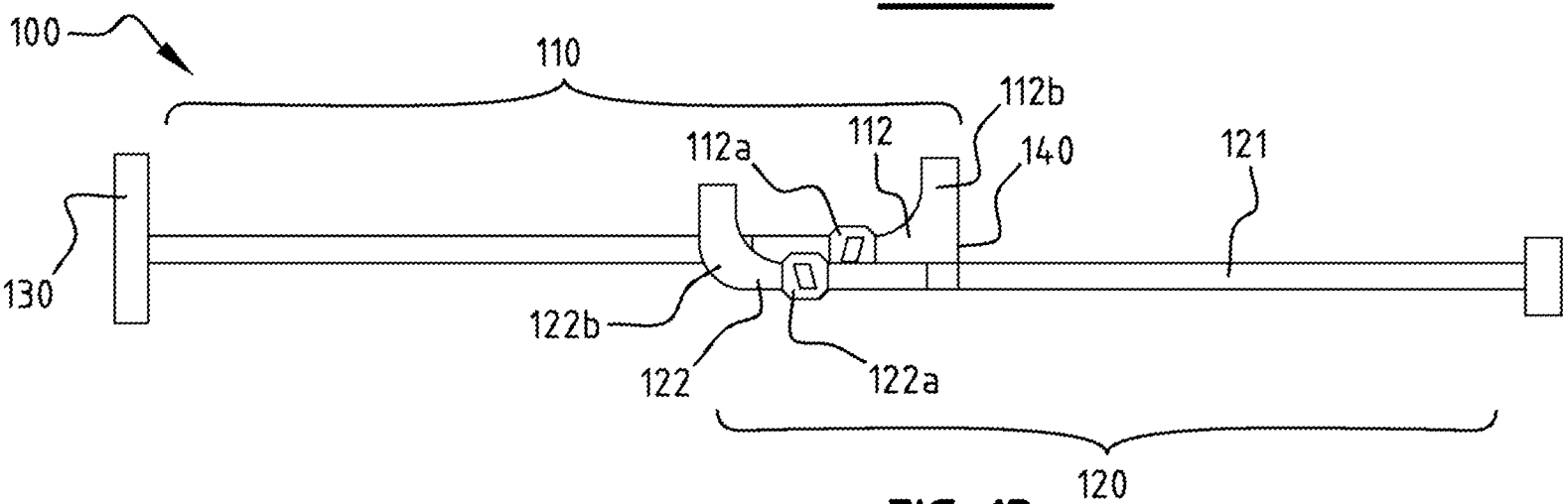
FIG. 1B is a schematic top view of the embodiment in FIG. 1A.

FIGS. 1A and 1B show an embodiment of an impact-attenuating device 100. The impact-attenuating device 100 comprises a first energy-absorbing part 110 and a second energy-absorbing part 120. The first energy-absorbing part 110 and the second energy-absorbing part 120 are positioned substantially one behind the other in a set-up state of the impact-attenuating device 100. The first energy-absorbing part 110 comprises a first elongate body 111 and a corresponding first energy converter 112. The first elongate body 111 and the first energy converter 112 are movable relative to each other. The first energy converter 112 is configured to deform the first elongate body 111 in the case of relative movement. The first elongate body 111 will thus for instance be deformed when it is pushed through the first energy converter 112 when a vehicle collides with the bumper 130 which is coupled to the first energy-absorbing part. The second energy-absorbing part 120 comprises a second elongate body 121 and a corresponding second energy converter 122. The second elongate body 121 and the second energy converter 122 are movable relative to each other. The second energy converter 122 is configured to deform the second elongate body 121 in the case of relative movement. The first and second energy-absorbing parts 110, 120 are coupled to each other such that the first elongate body 111 and the second elongate body 121 are deformed at least partially simultaneously by respectively the corresponding first energy converter 112 and the corresponding second energy converter 122 when a vehicle crashes into bumper 130. The coupling that provides therefor is shown schematically as element 140. This coupling 140 ensures that when a force is exerted on first energy converter 112, for instance due to a collision, this force brings about a movement of the second energy converter 122 relative to the second elongate body 121. In this way it is achieved that first energy-absorbing part 110 and second energy-absorbing part 120 are simultaneously active for the longest possible period of time. This ensures that the energy of a collision can be absorbed uniformly because several energy-absorbing elements co-act in order to prevent peaks in the energy absorption, i.e. the deceleration of the colliding vehicle. It will be apparent to the skilled person that the coupling 140 can be designed in different ways resulting in the above-described objective. Without limiting the scope of protection thereto, an advantageous embodiment of such a coupling 140 is described with reference to the embodiment of FIGS. 4B and 4C.

The first and second energy converters 112, 122 comprise respectively first and second cutting means 112*a*, 122*a* configured to cut respectively the first and second elongate bodies 111 121. By cutting the elongate bodies energy from the collision or crash is absorbed. The elongate bodies are formed by tubular profiles having a substantially square cross-section. It will however be apparent to the skilled person that tubular profiles with other cross-sections can be used in the present impact-attenuating device, such as rectangular, hexagonal, octagonal, round and so on. The cutting means can each comprise one or more cutting surfaces. The elongate body in question can thus be cut into two or more pieces, depending on the configuration of the one or more cutting surfaces. Without limiting the scope of protection thereto, several advantageous preferred embodiments of the cutting means 212*a* are shown with reference to FIGS. 2A, 2B and 2C.

The shown first and second energy converters 112, 122 also have respectively a first and second bending part 112*b*, 122*b*, which are situated downstream of the cutting means 112*a*, 122*a* and are configured to bend the cut first and second elongate bodies 111, 121. The energy can hereby be further absorbed in efficient manner by bending the cut parts of the elongate bodies, by the friction created during the bending and/or by the mass inertia of the different components which are set into motion. The overall energy of the colliding vehicle is hereby absorbed in efficient and uniform manner. This is because known impact-attenuating devices which are based mainly on cutting force have the drawback that a final peak is caused in the energy absorption, and so in the deceleration profile of the colliding vehicle. This is detrimental to the safety of the occupants of the vehicle.

Figure 2A:
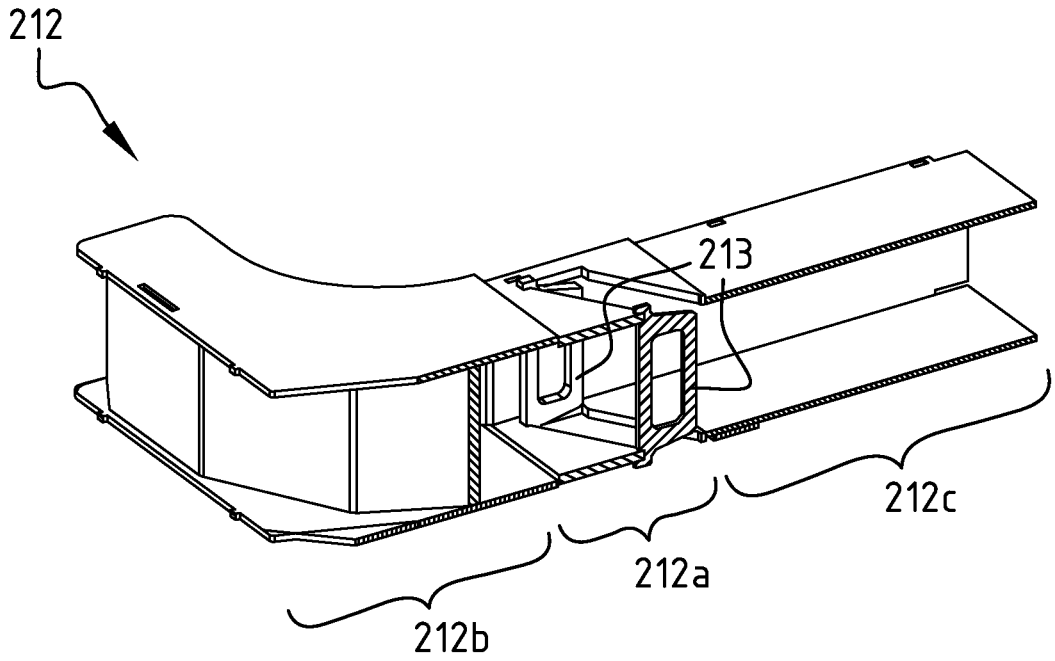
FIG. 2A is a perspective view of a preferred embodiment of an energy converter.
Figure 2B:
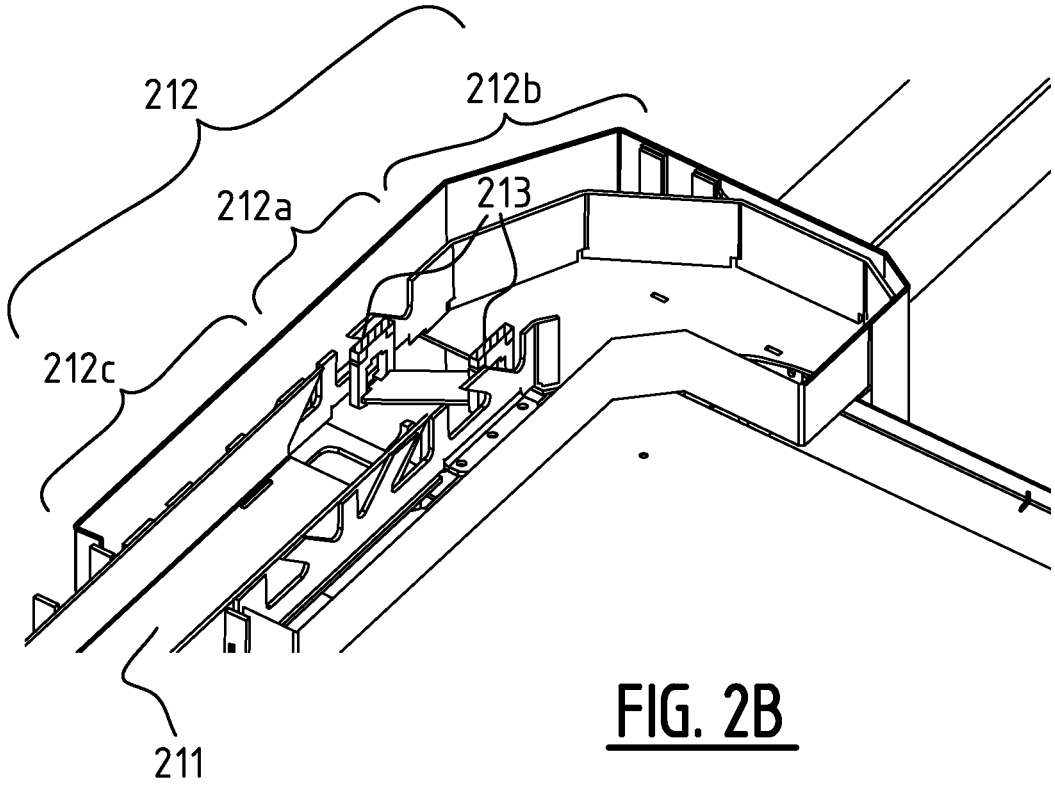
FIG. 2B is an open perspective view of another preferred embodiment of an energy converter and a part of an elongate body.
Figure 2C:
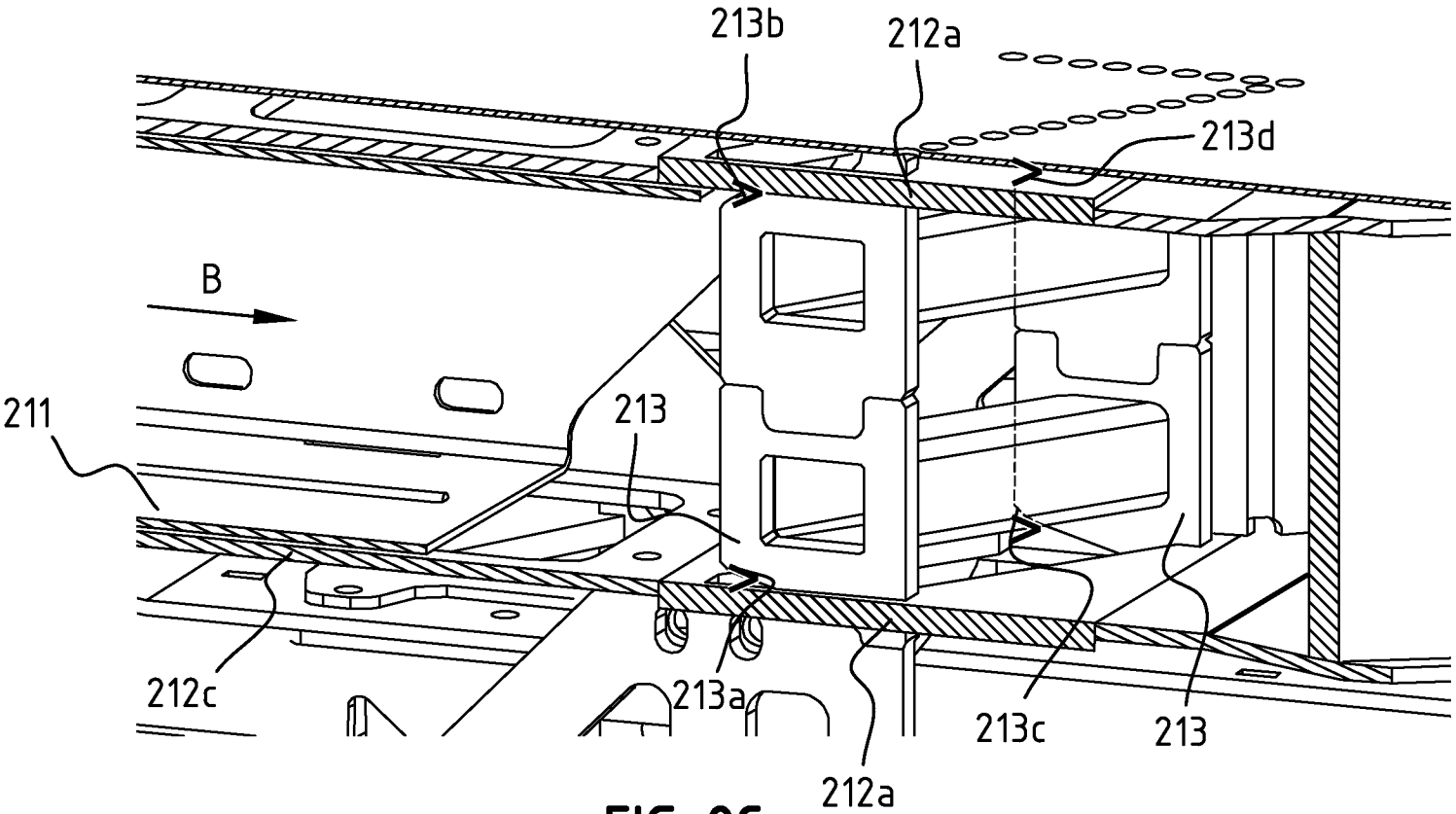
FIG. 2C is a detail view of a preferred embodiment of a side part and cutting means in an energy converter.

FIGS. 2A, 2B and 2C show preferred embodiments of (parts of) an energy converter 212 which can be used in the first and/or second energy-absorbing parts. FIGS. 2A and 2B show energy converters 212 which comprise a guide part 212*c*, cutting means 212*a* and a bending part 212*b*.

FIG. 2C shows a detail view of the cutting means 212*a* according to an embodiment. The guide part 212*c* ensures that the tubular profile 211 in question is guided in efficient manner in the direction of the cutting means 212*a*, indicated by arrow B in FIG. 2C, in the case of a collision. This contributes advantageously to the correct cutting of the tubular profile 211. Cutting means 212*a* comprise one or more blades 213. Without limiting the scope of protection thereto, different advantageous preferred embodiments of blades 213 are shown in FIGS. 2A-2C. It will however be apparent to the skilled person that other arrangements and forms of blades 213 are applicable in the impact-attenuating device. After tubular profile 211 has been cut by blades 213 the cut parts are guided through bending part 212*b* and bent. The shown bending parts 212*b* are configured to bend the cut parts through a substantially right angle. In this way it is ensured that the cut and bent parts of the tubular profile are discharged in safe manner, without endangering the occupants of the colliding vehicle or any bystanders here. It will however be apparent to the skilled person that the cut parts of the tubular profile can also be bent through a different angle, for instance through an angle of between 45° and 135°, preferably between 60° and 120°, more preferably between 70° and 110°, and still more preferably between 80° and 100°.

The blades 213 are preferably disposed substantially parallel relative to each other. In advantageous embodiments the blades are disposed such that they do not come into initial contact with the elongate body in question simultaneously. As shown in FIGS. 2A, 2B and 2C, the blades are positioned with an offset relative to each other. In this way it is ensured that the energy absorption is built up gradually. By using each blade, cutting surface or cutting surface pair individually and in succession the cutting force which absorbs the energy is built up over a longer distance, and this decreases the chance of a pressure surge. Alternatively or in addition to the positioning of the blades 213, the tubular profile 211 can advantageously be designed to contribute to the uniform buildup of the force, and so to the uniform absorption of the energy. In the embodiments of FIGS. 2B and 2C tubular profile 211 is formed at an outer end thereof directed toward blades 213 such that a side, in this case the upper side, of the tubular profile 211 protrudes relative to an opposite side, in this case the underside, of the tubular profile 211. This also contributes to a gradual buildup of the force used to absorb the energy of a colliding vehicle. In the embodiment of FIG. 2C four cutting surface pairs 213*a*, 213*b*, 213*c* and 213*d* are thus formed, these coming into contact with tubular profile 211 in turns. The shown cutting surface pairs 213*a*, 213*b*, 213*c* and 213*d* (indicated by "<" in FIG. 2C) are formed by an oblique side of the arranged blades 213, the first cutting surface of the cutting surface pair, and an adjacent side of a housing of cutting means 212*a*, the second cutting surface of the cutting surface pair. Each cutting surface pair 213*a*, 213*b*, 213*c* and 213*d* will thus operate according to a principle of opened scissors and successively engage on tubular profile 211. Cutting surface pair 213*b* will first engage on the upper side of the tubular profile, followed by cutting surface pairs 213*d* and 213*a*, and, finally, cutting surface pair 213*c* will engage on tubular profile 211.

Alternatively or in addition to the above described measures, the tubular profile can be provided at an outer end thereof with at least one guiding recess. The tubular profile is preferably provided at an outer end directed toward cutting means 212*a* and in one or more walls of the tubular profile with holes serving as guiding recess. Providing these holes, which can have different shapes, further achieves that the cutting force which absorbs the energy is built up over a longer distance and in uniform manner.

It is noted that the energy converters and components thereof shown in FIGS. 2A-2C can be used as first and/or second energy converter in respectively the first and/or second energy-absorbing part of the present impact-attenuating device. It will further be apparent that specific features of different embodiments are mutually interchangeable or replaceable.

In the embodiment of FIGS. 1A and 1B the first energy-absorbing part 110 consists of a first elongate body 111 and a corresponding first energy converter 112. The second energy-absorbing part 120 consists of a second elongate body 121 and a corresponding second energy converter 122. In further preferred embodiments the first energy-absorbing part comprises two or more first elongate bodies and corresponding first energy converters, and the second energy-absorbing part comprises two or more second elongate bodies and corresponding second energy converters. It is an advantage of several embodiments that similar elongate bodies and energy converters can be used in the first and second energy-absorbing part. In other words, the first and second energy-absorbing part can be formed by a well-chosen combination of elongate body and corresponding energy converter. Use thus need not be made of different components for the different energy-absorbing parts, but the same components can be used in modular manner. The production costs are hereby relatively low compared to other impact-attenuating devices comprising more different components.

Figure 3A:
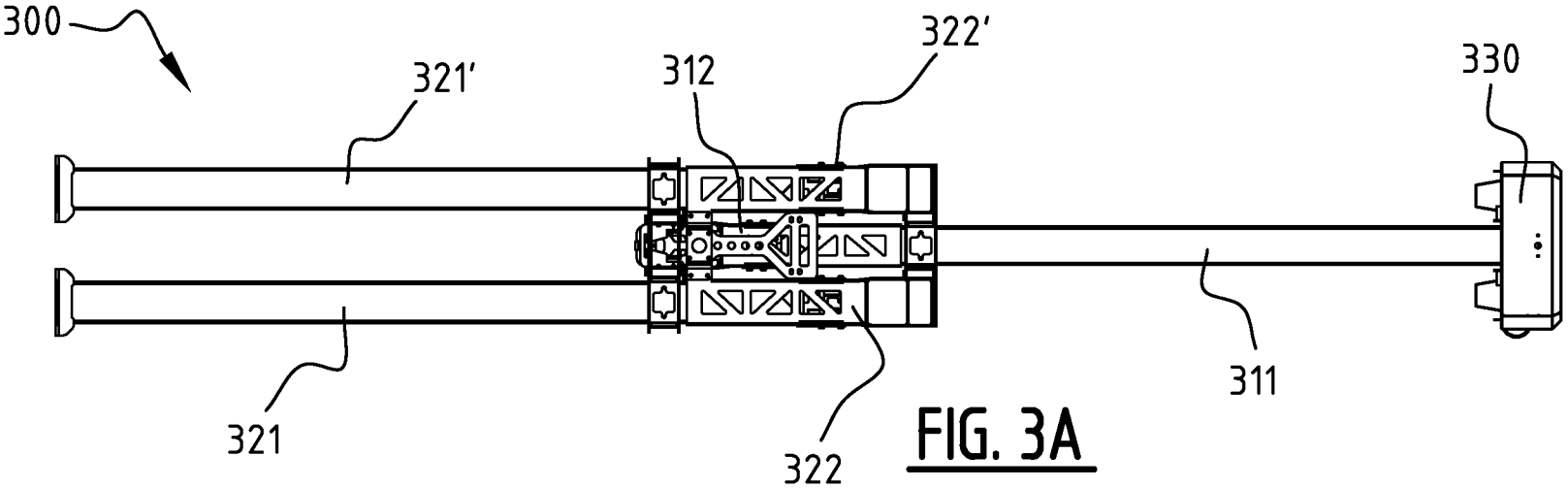
FIG. 3A is a side view of a preferred embodiment of an impact-attenuating device in set-up state.
Figure 3B:
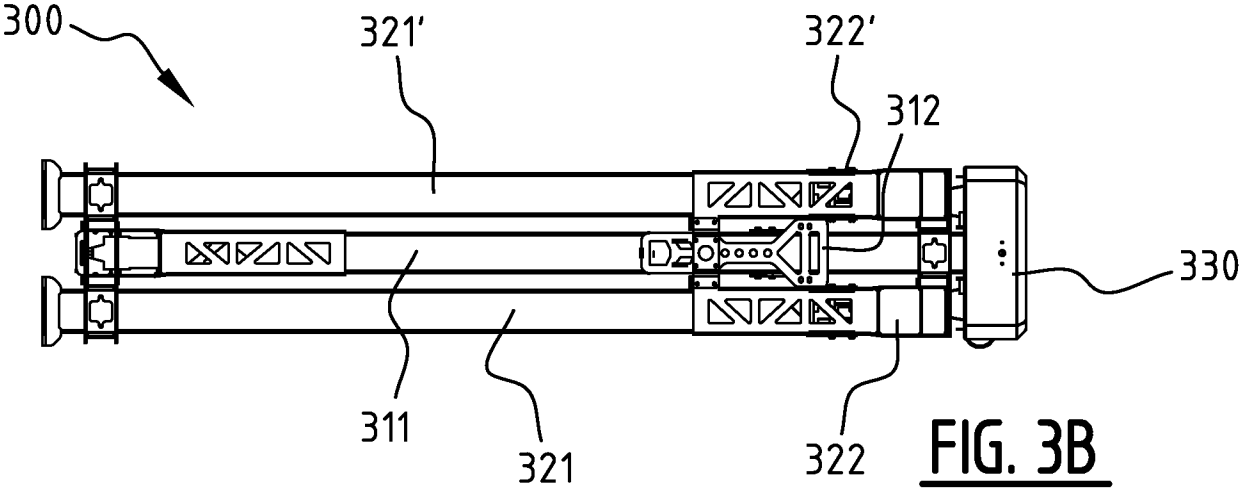
FIG. 3B is a side view of the embodiment in FIG. 3A in compact state.
Figure 3C:
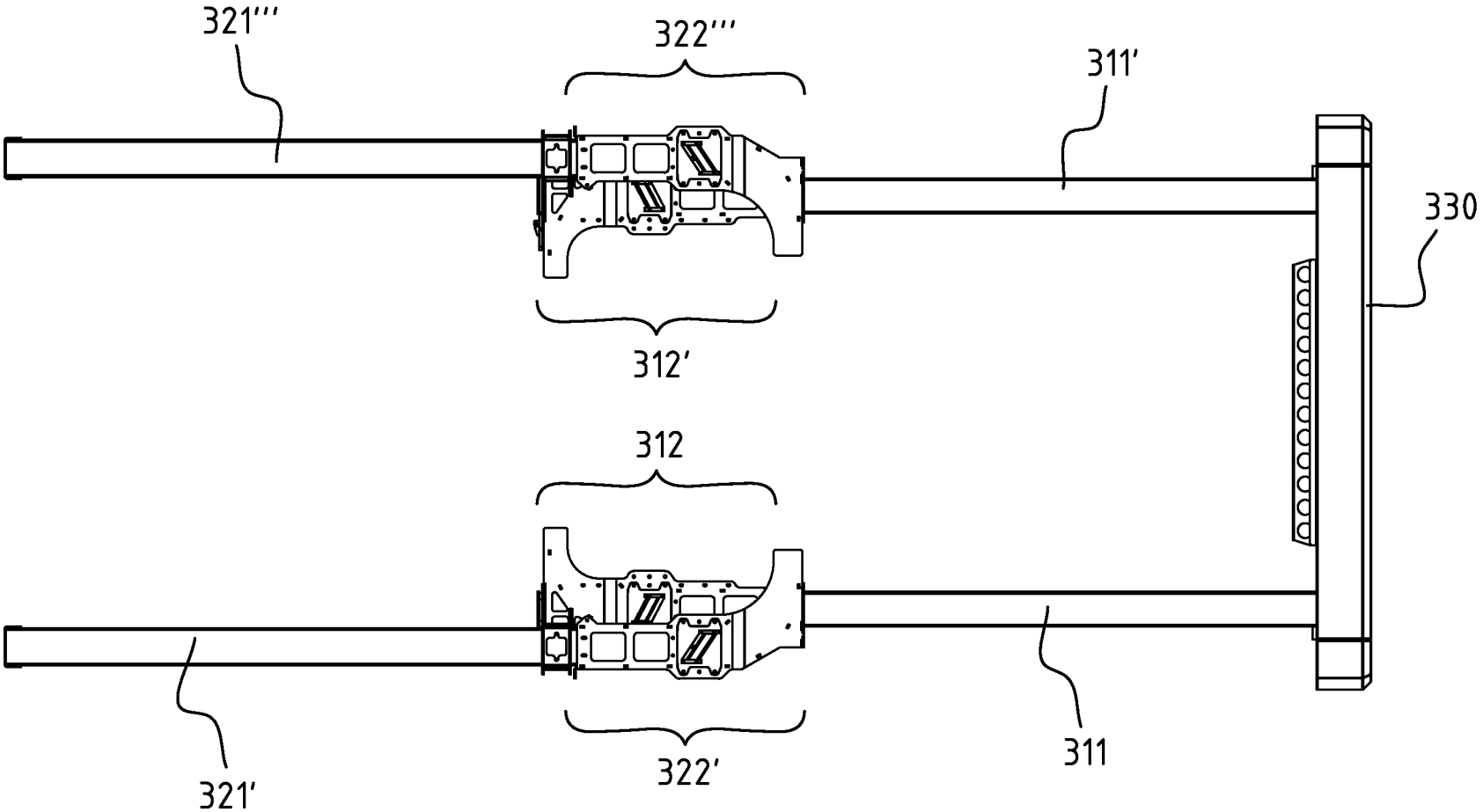
FIG. 3C is a top view of the embodiment in FIG. 3A in set-up state.
Figure 3D:
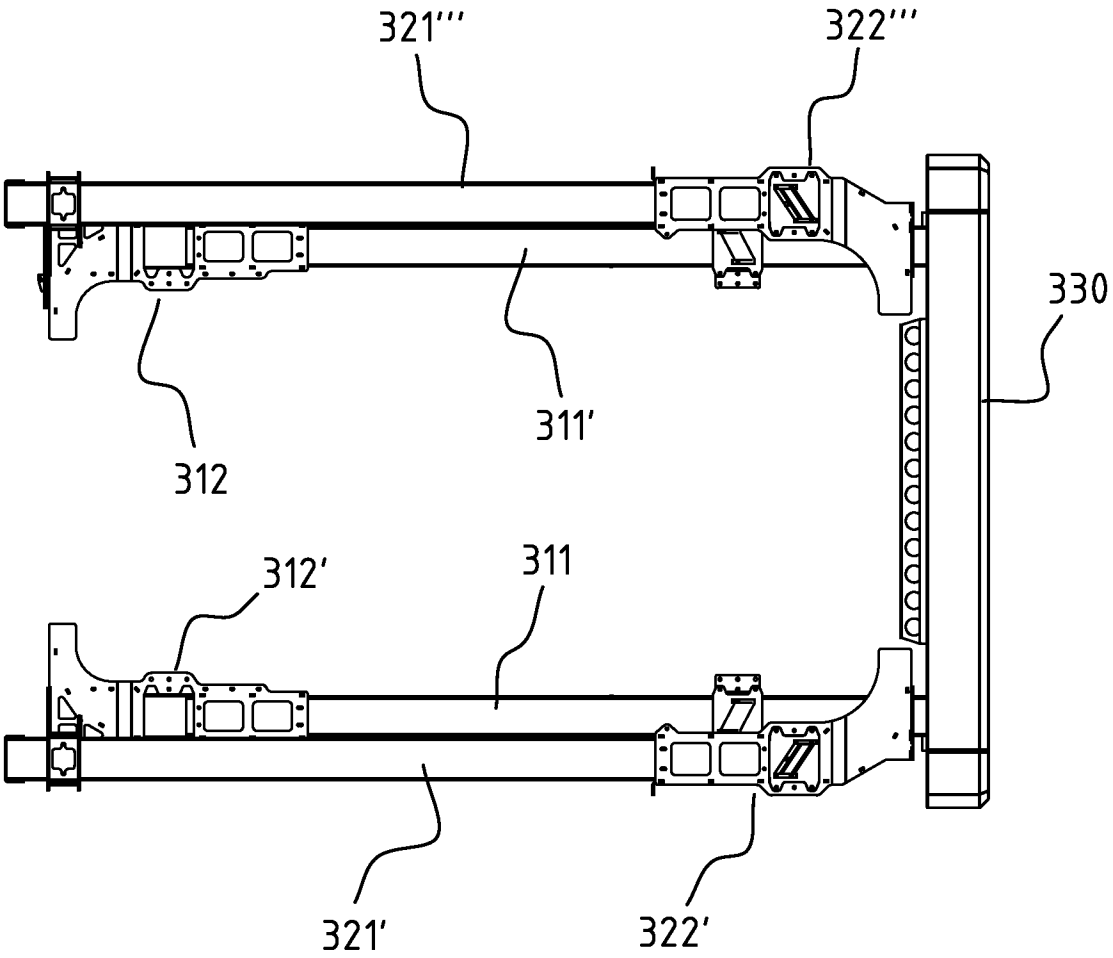
FIG. 3D is a top view of the embodiment in FIG. 3A in compact state.
Figure 3E:
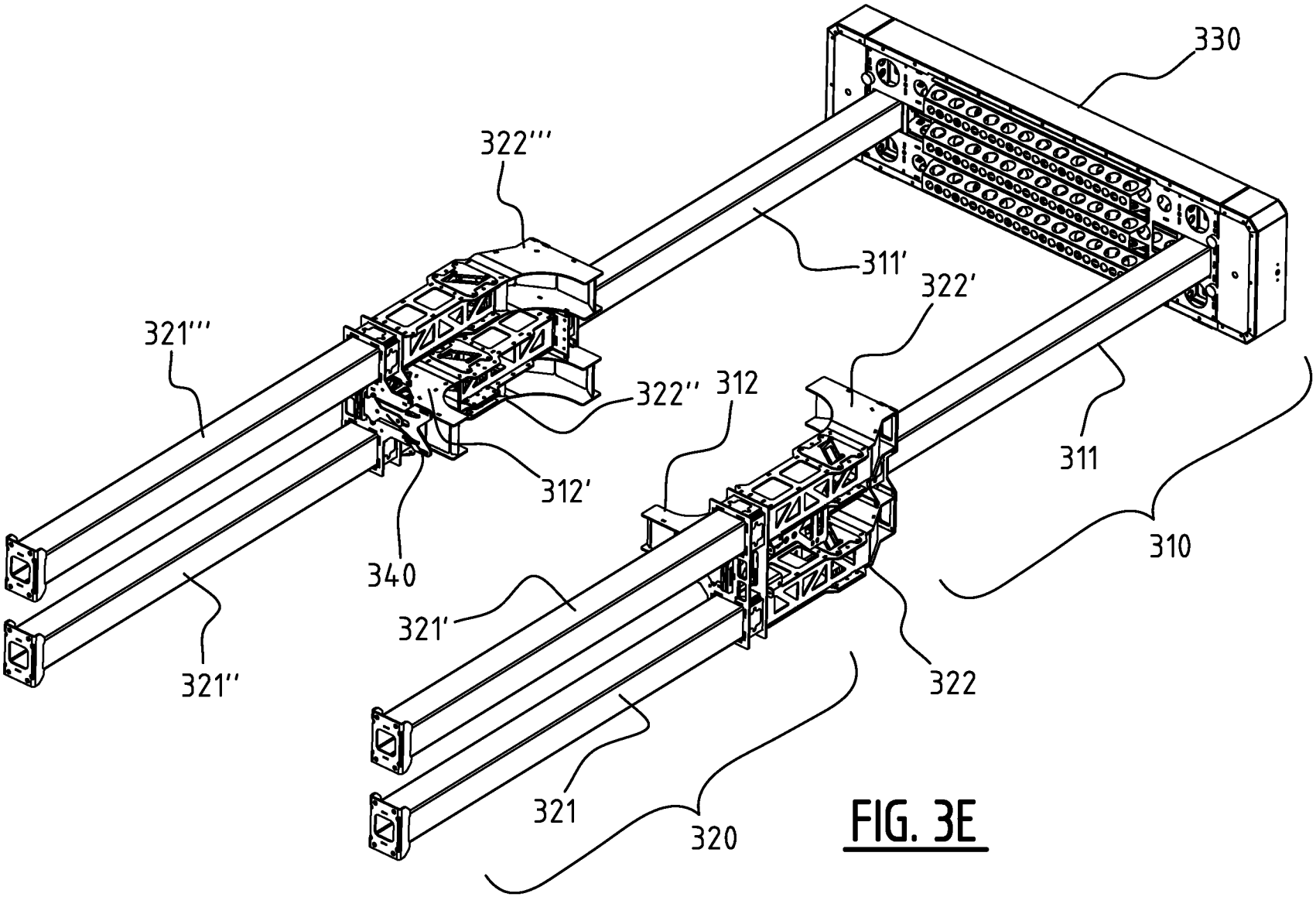
FIG. 3E is a perspective view of the embodiment in FIG. 3A in set-up state.
Figure 3F:
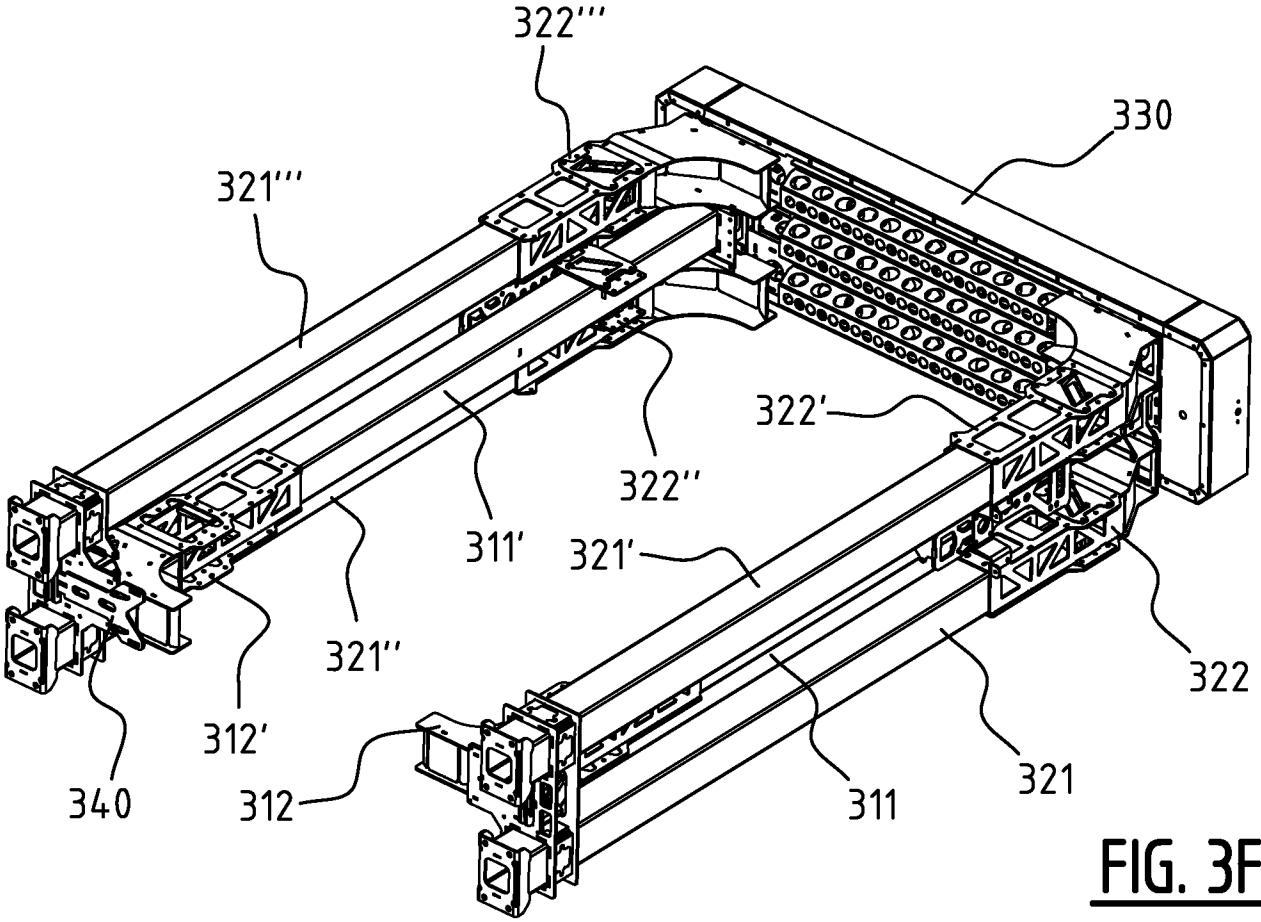
FIG. 3F is a perspective view of the embodiment in FIG. 3A in compact state.

FIGS. 3A-3F show an embodiment of an impact-attenuating device 300 wherein the first energy-absorbing part 310, which is connected to the bumper 330, comprises two first elongate bodies 311, 311' and two corresponding first energy converters 312, 312'. The second energy-absorbing part 320, which can be connected to a vehicle, trailer and/or tilting mechanism (not shown), comprises four second elongate bodies 321, 321', 321" and 321'" and four corresponding second energy converters 322, 322', 322" and 322'". The first energy-absorbing part 310 and the second energy-absorbing part 320 are movable relative to each other between a set-up state, wherein the first and second energy-absorbing part 310, 320 are placed substantially one behind the other, and a compact state wherein the first and second energy-absorbing parts 310, 320 are placed substantially adjacently of each other. FIGS. 3A, 3C and 3E show different views of the impact-attenuating device 300 in the set-up state. FIGS. 3B, 3D and 3F show different views of the impact-attenuating device 300 in compact state. In the shown embodiments the set-up state corresponds with a setup wherein the first energy-absorbing part 310 has been extended forward (in the direction of the bumper) relative to the second energy-absorbing part 320, and the compact state corresponds with a setup wherein the first energy-absorbing part 310 has been retracted to a position between or adjacently of the second energy-absorbing part 320. The compact state can for instance be used for transporting impact-attenuating device 300 in efficient and safe manner. In the shown embodiment the first and second energy-absorbing parts 310, 320 are slidable relative to each other. It will however be apparent to the skilled person that the energy-absorbing parts 310, 320 can be similarly rotatable, tiltable, movable and/or pivotable relative to each other between a set-up state and a compact state. In the set-up state the distance between bumper 330 and the opposite outer end of the second energy-absorbing part is greater than in the compact state. The distance between bumper 330 and the opposite outer end of the second energy-absorbing part, which can be connected to a coupling, is preferably maximal.

The two first elongate bodies 311, 311' are mutually parallel and extend adjacently of each other. alternatively or additionally, the first elongate bodies can also extend above and below each other. The two first elongate bodies 311, 311' are both connected to the bumper and are placed in corresponding two first energy converters 312, 312' at the outer ends positioned opposite the bumper. In the case of an impact against the bumper the two first elongate bodies 311, 311' will be pushed through the corresponding two first energy converters. It will however be apparent to the skilled person that one or two of the two first energy converters 312, 312' can be situated at the outer end coupled to the bumper. The energy converter in question is then pushed "over" the corresponding elongate body. In any case, there will be relative movement between the elongate body and the corresponding energy converter, and the elongate body will hereby be accelerated and/or bent. The elongate body is preferably first cut and then bent and/or deformed, as discussed above with reference to FIGS. 2A-2C.

The four second elongate bodies 321, 321', 321" and 321'" are mutually parallel and extend adjacently of and/or above/below each other. In a view looking from bumper 330 to the four second elongate bodies 321, 321', 321" and 321'" the position of each of the four second elongate bodies 321, 321', 321" and 321'" corresponds with the corner point of a rectangle.

In the compact state the two first elongate bodies 311, 311' are situated more or less between (in the view of FIG. 3B) and adjacently of (in the view of FIG. 3D) the four second elongate bodies 321, 321', 321" and 321'".

Due to mechanical considerations, the various components of the first and second energy-absorbing part 310, 320 are mounted in a frame which allows the functionality described in this text. On the basis of the description in this text the skilled person can realize such a frame in different ways. The exact embodiment of the frame therefore does not form the subject of this patent application.

The four second energy converters 322, 322', 322" and 322'" are positioned at the outer ends of the four second elongate bodies 321, 321', 321" and 321'" directed toward the bumper. It will however be apparent to the skilled person that, on the basis of the principle of mechanical reversal, one or more of the four second energy converters 322, 322', 322" and 322'" can be situated at the outer end of the relevant second elongate body remote from the bumper. The two first energy converters 312, 312' and four second energy converters 322, 322', 322" and 322'" are formed according to one of the embodiments as shown in FIGS. 2A-2C or a combination thereof. So as to avoid repetition, the energy converters 312, 312', 322, 322', 322" and 322'" are not described at length here.

The first and second energy-absorbing parts 310, 320 have mutually differing conversion resistances, in this case due to the mutually differing construction. This means that the first energy-absorbing part 310 and the second energy-absorbing part 320 will contribute to the energy absorption to greater or lesser extent relative to each other when they are considered individually and at rest. The first energy-absorbing part 310 preferably has a first conversion resistance smaller than a second conversion resistance of the second energy-absorbing part 320. In other words, the second energy-absorbing part 320 is able to absorb more energy than the first energy-absorbing part 310. This difference however no longer applies during operation wherein the first and second energy-absorbing part 310, 320 of the impact-attenuating device 300 are coupled in specific manner.

The first and second energy-absorbing parts 310, 320 are coupled to each other in the set-up state by means of a coupling 340 which is configured to block relative movement of the first energy-absorbing part 310 and the second energy-absorbing part 320. During operation the components of the first energy-absorbing part 310 and the components of the second energy-absorbing part 320 hereby largely co-act to convert the kinetic energy of a colliding vehicle in uniform manner and so absorb it. As mentioned above, this co-action of the parts 310, 320 placed one behind the other ensures that peaks are filtered from the deceleration profile of the colliding vehicle. A preferred embodiment of such a coupling 340 is discussed in more detail with reference to FIGS. 4A-4D, particularly FIG. 4C. It will be apparent to the skilled person that the coupling 340 has a released or open state and a coupled or closed state. In the released state of coupling 340 the first and second energy-absorbing parts 310, 320 can be moved as a whole relative to each other. In the closed state of coupling 340 this is not possible. The coupling 340 can be brought into the open or closed state manually or remotely. Coupling 340 can take a single or multiple form. This means that the coupling 340 can engage at one specific location or at two or more locations in order to couple the first and second energy-absorbing parts 310, 320 to each other.

The first energy-absorbing part 310 preferably comprises an interlocking means configured on the one hand to block relative movement of the first elongate body 311 and the first energy converter 312 when a force exerted on the interlocking means is smaller than a predetermined threshold value and, on the other hand, to release relative movement of the first elongate body 311 and the first energy converter 312 when the force exerted on the interlocking means is greater than the predetermined threshold value.

Similarly, the second energy-absorbing part 320 preferably comprises an interlocking means which is configured on the one hand to block relative movement of the second elongate body 321 and the second energy converter 322 when a force exerted on the interlocking means is smaller than a predetermined threshold value and, on the other hand, to release relative movement of the second elongate body 321 and the second energy converter 322 when the force exerted on the interlocking means is greater than the predetermined threshold value. A preferred embodiment of such an interlocking means is discussed in more detail with reference to FIGS. 4A-4D, particularly FIG. 4D.

Figure 4A:
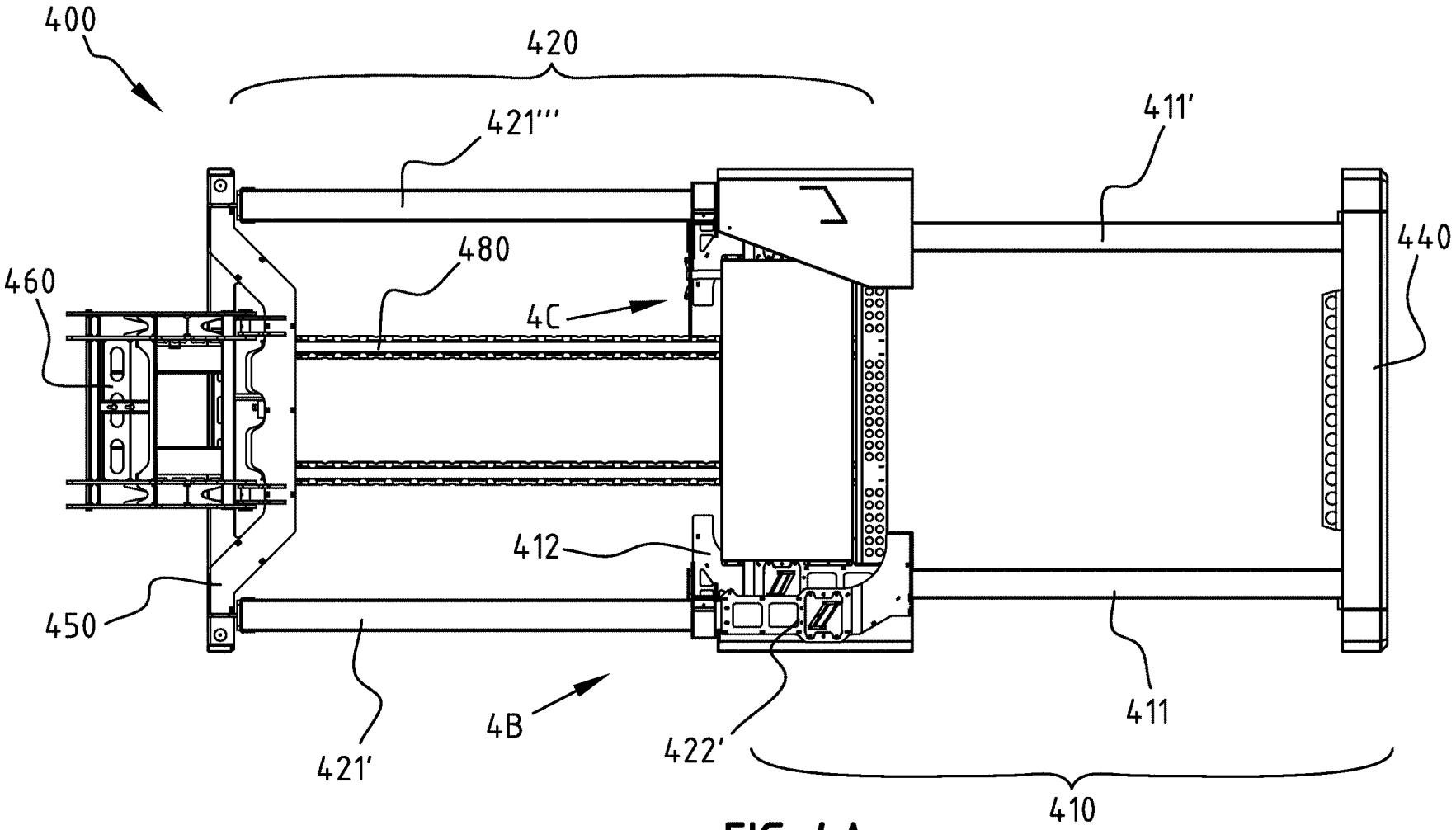
FIG. 4A is a top view of a preferred embodiment of an impact-attenuating device.

FIG. 4A shows a top view of an impact-attenuating device 400 which is similar to the embodiment as shown in FIG. 3C. Further shown in FIG. 4A is a coupling 450, by means of which the second energy-absorbing part 420 is coupled to a tilting installation 460, and a drive system 480 for bringing about the above-described relative movement of the first and second energy-absorbing part 410, 420.

Figure 4B:
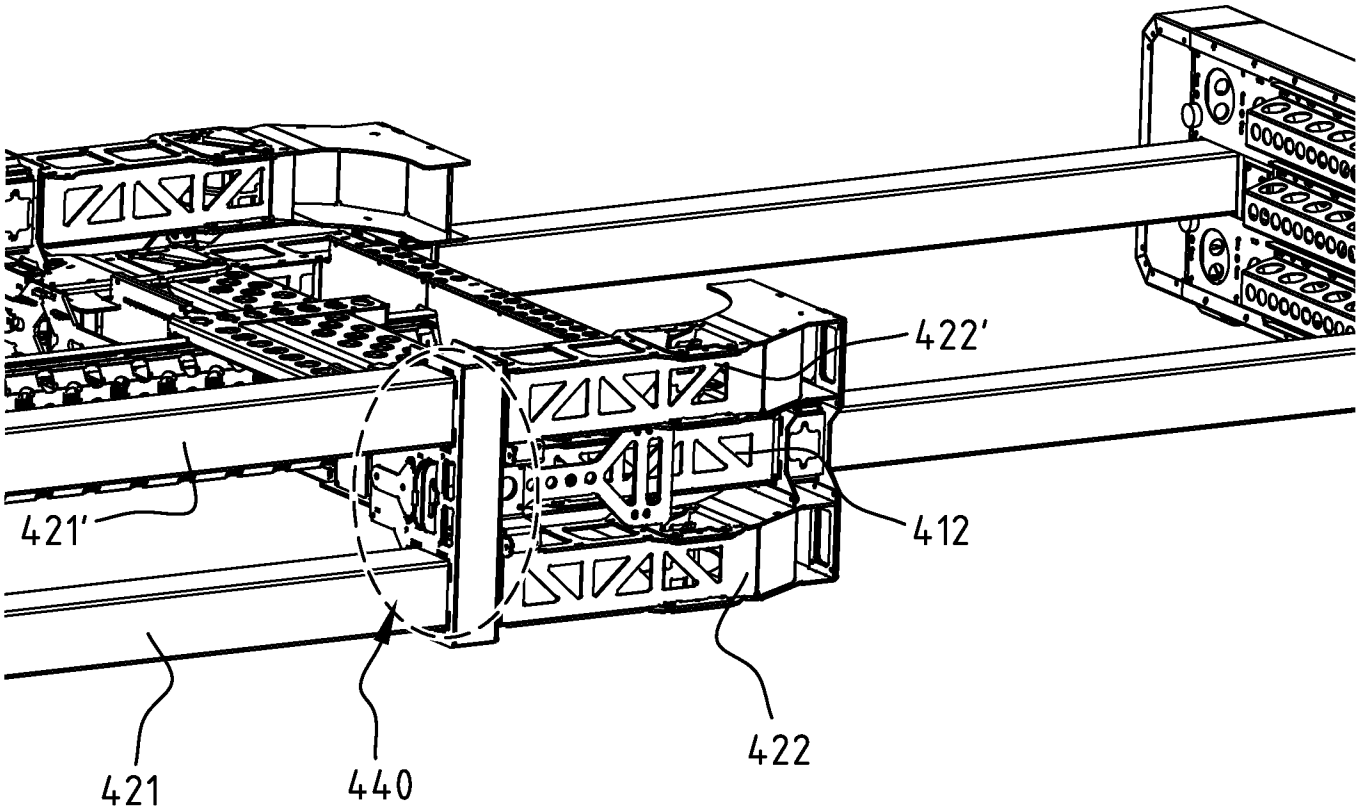
FIG. 4B is a perspective view of a part of the impact-attenuating device.

FIG. 4B shows a detail view in the direction of arrow 4B in FIG. 4A.

Figure 4C:
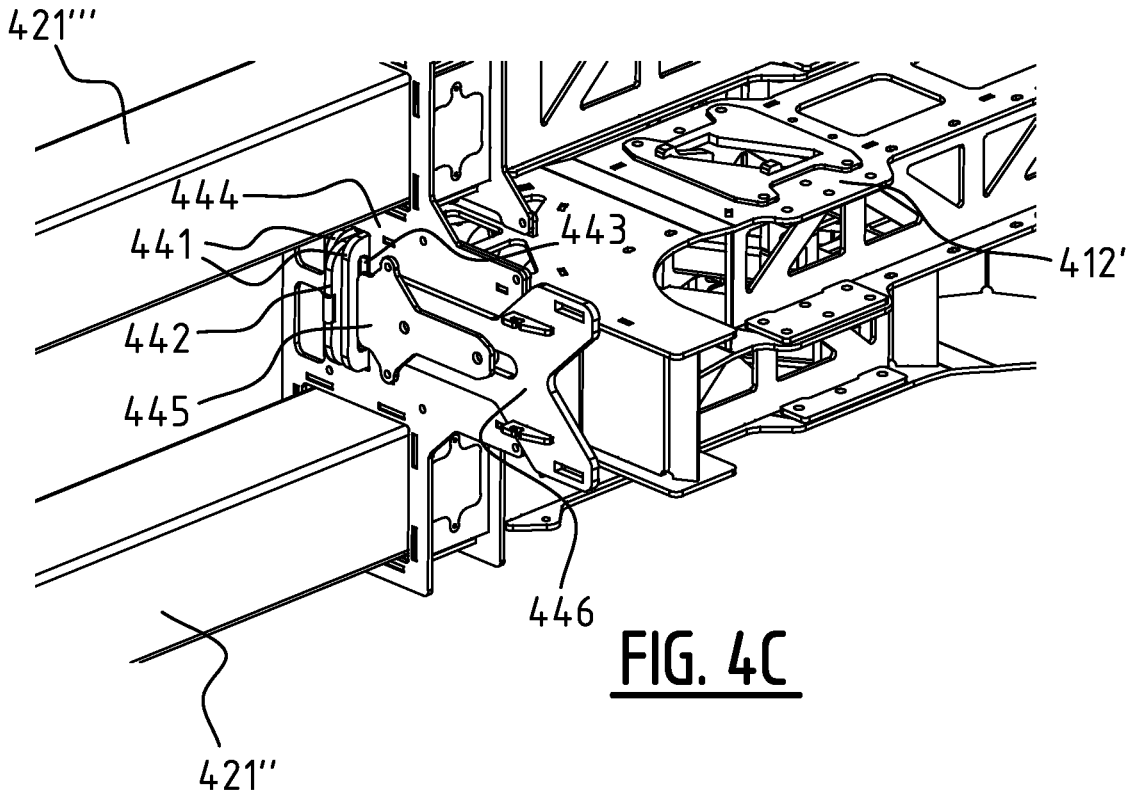
FIG. 4C is a detail view of an embodiment of a coupling between the first and second energy-absorbing part.

FIG. 4C shows a detail view in the direction of arrow 4C in FIG. 4A.

FIGS. 4B and 4C show a coupling 440, which is discussed in more detail with reference to FIG. 4C. In this case this is a double coupling 440 which engages on both the side of arrow 4B (FIG. 4B) and the side of arrow 4C (FIG. 4C) on the first and second energy-absorbing parts 410, 420. It will be apparent to the skilled person that the coupling 440 can also take the form of a single or multiple coupling. The coupling 440 is brought about when the impact-attenuating device 400 is in the set-up, extended state. In the shown embodiment the coupling takes the form of sliding lock 440. Two plates with a slot 441 are provided on first energy-absorbing part 410. When the first energy-absorbing part 410 is in its most extended state, a lock plate 442, which is arranged on the second energy-absorbing part 420, will be positioned precisely between them. The slot of lock plate 442 then corresponds with the slots of plates 441. A passage 443 through these three parts 441, 442 allows the whole to be locked. Between the frame 444 of first energy-absorbing part 410 and a gliding plate 445 the sliding plate 446 of the lock can slide through the opening 443.

Figure 4D:
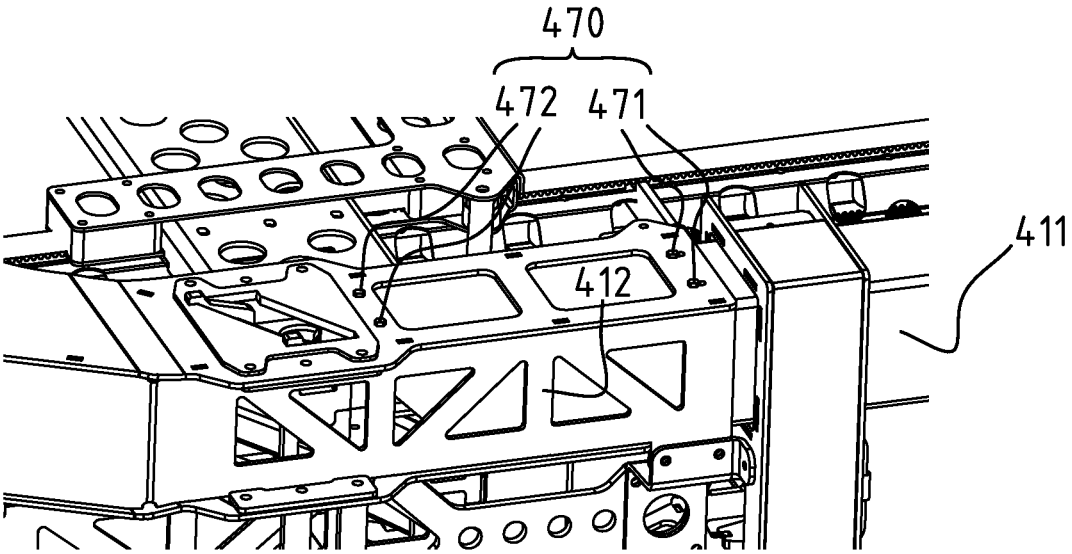
FIG. 4D is a detail view of an embodiment of a locking of the second energy-absorbing part.

FIG. 4D shows a detail view of energy converter 412 which is provided with an interlocking means 470 configured on the one hand to block relative movement of the first elongate body 411 and the first energy converter 412 when a force exerted on interlocking means 470 is smaller than a predetermined threshold value and, on the other hand, to release relative movement of the first elongate body 411 and the first energy converter 412 when the force exerted on interlocking means 470 is greater than the predetermined threshold value. In FIG. 4D the interlocking means 470 is formed by means of two pairs of shear pins 471, 472. The shear pins 471, 472 ensure that the elongate body 411 is not cut and/or bent unintentionally by the energy converter 412. When the impact-attenuating device 400 is in the set-up state, and when an impact against the bumper takes place, shear pins 471, 472 will break and thus allow a relative movement of the elongate body 411 and the energy converter 412. It will be apparent to the skilled person that the interlocking means 470 can be realized in other ways and that the interlocking means 470 must not be limited by the specific shown embodiment. It will further be apparent to the skilled person that interlocking means 470 can comprise one or more shear pins, which can be positioned in different ways.

On the basis of the above it will be apparent to the skilled person that the present impact-attenuating device is able to absorb kinetic energy of a colliding vehicle in uniform manner. The skilled person will further appreciate that the invention is not limited to the above-described embodiments and that many modifications and variants are possible within the scope of the invention, which is defined solely by the following claims.

The invention claimed is:

1. An impact-attenuating device, comprising:

a first energy-absorbing part comprising at least one first elongate body and at least one corresponding first energy converter, wherein the first elongate body and the first energy converter are movable relative to each other and wherein the first energy converter is configured to deform the first elongate body in the case of relative movement;

a second energy-absorbing part comprising at least one second elongate body and at least one corresponding second energy converter, wherein the second elongate body and the second energy converter are movable relative to each other and wherein the second energy converter is configured to deform the second elongate body in the case of relative movement; and a bumper coupled to the first energy-absorbing part;

wherein the first and second energy-absorbing part can be positioned substantially one behind the other;

wherein the first and second energy-absorbing part are mutually coupled such that the at least first elongate body and the at least second elongate body are deformed at least partially simultaneously by respectively the at least one corresponding first energy converter and the at least one corresponding second energy converter when a vehicle crashes into the bumper; and wherein the first energy-absorbing part and the second energy-absorbing part are movable relative to each other between an extended state, wherein the first and second energy-absorbing parts are placed substantially one behind the other, and a compact state wherein the first and second energy-absorbing parts are placed substantially one next to or above the other;

wherein the first and second energy converters comprise respectively first and second cutting means which are configured to cut respectively the first and second elongate bodies.

2. The impact-attenuating device according to claim 1, wherein the first and second energy converters comprise respectively a first and second bending part configured to bend respectively the first and second elongate bodies.

3. The impact-attenuating device according to claim 1, wherein the first and second energy-absorbing parts have mutually differing conversion resistances.

4. The impact-attenuating device according to claim 3, wherein the first energy-absorbing part has a first conversion resistance and the second energy-absorbing part a second conversion resistance, and wherein the first conversion resistance is smaller than the second conversion resistance.

5. The impact-attenuating device according to claim 1, wherein the first and second energy-absorbing parts are mutually coupled by means of a coupling which is configured to block relative movement of the first energy-absorbing part and the second energy-absorbing part.

6. The impact-attenuating device according to claim 1, wherein the first energy-absorbing part comprises an interlocking means which is configured to:

block relative movement of the first elongate body and the first energy converter when a force exerted on the interlocking means is smaller than a predetermined threshold value; and release relative movement of the first elongate body and the first energy converter when the force exerted on the interlocking means is greater than the predetermined threshold value.

7. The impact-attenuating device according to claim 1, wherein the second energy-absorbing part comprises an interlocking means which is configured to:

block relative movement of the second elongate body and the second energy converter when a force exerted on the interlocking means is smaller than a predetermined threshold value; and release relative movement of the second elongate body and the second energy converter when the force exerted on the interlocking means is greater than the predetermined threshold value.

8. The impact-attenuating device according to claim 1, wherein the first and second energy converters comprise respectively a first and second guide part which are arranged to guide respectively the first and second elongate bodies in the first and second energy converters.

9. The impact-attenuating device according to claim 1, wherein the first and second energy converters are respectively arranged at an outer end of respectively the first and second elongate bodies; and/or wherein the first energy converter is arranged at an outer end of the first elongate body which is directed away from the bumper; and/or wherein the second energy converter is arranged at an outer end of the second elongate body which is directed toward the bumper.

10. The impact-attenuating device according to claim 1, wherein the first and/or second cutting means comprise at least two cutting surfaces forming a cutting surface pair; and/or wherein the first and/or second cutting means comprise a plurality of cutting surface pairs which are positioned such that they do not come into contact with the elongate body in question simultaneously; and/or wherein the plurality of cutting surface pairs are disposed substantially parallel relative to each other.

11. The impact-attenuating device according to claim 1, wherein the elongate bodies comprise tubular profiles.

12. The impact-attenuating device according to claim 11, wherein the tubular profiles have a substantially rectangular or substantially square cross-section; and/or wherein the tubular profiles are provided at an outer end thereof with at least one guiding recess.

13. The impact-attenuating device according to claim 2, wherein the first and/or second bending part is configured to bend the respective first and/or second elongate body through an angle of between 45° and 135°.

14. The impact-attenuating device according to claim 1, further comprising a coupling means for coupling to a tilting mechanism, wherein the impact-attenuating device is tiltable between a substantially horizontal operative state and a substantially vertical transport state.

15. The impact-attenuating device according to claim 1, wherein the first energy-absorbing part comprises two first elongate bodies and two corresponding first energy converters, wherein the two first elongate bodies extend substantially parallel relative to each other.

16. The impact-attenuating device according to claim 1, wherein the second energy-absorbing part comprises two second elongate bodies and two corresponding second energy converters, and wherein the two second elongate bodies extend substantially parallel relative to each other.

17. A vehicle provided with the impact-attenuating device according to claim 1.

18. A trailer provided with the impact-attenuating device according to claim 1.

19. An impact-attenuating device, comprising:

a first energy-absorbing part comprising at least one first elongate body and at least one corresponding first energy converter, wherein the first elongate body and the first energy converter are movable relative to each other and wherein the first energy converter is configured to deform the first elongate body in the case of relative movement;

a second energy-absorbing part comprising at least one second elongate body and at least one corresponding second energy converter, wherein the second elongate body and the second energy converter are movable relative to each other and wherein the second energy converter is configured to deform the second elongate body in the case of relative movement; and a bumper coupled to the first energy-absorbing part;

wherein the first and second energy-absorbing part can be positioned substantially one behind the other; and wherein the first and second energy-absorbing part are mutually coupled such that the at least first elongate body and the at least second elongate body are deformed at least partially simultaneously by respectively the at least one corresponding first energy converter and the at least one corresponding second energy converter when a vehicle crashes into the bumper;

wherein the first and second energy converters comprise respectively a first and second guide part which are arranged to guide respectively the first and second elongate bodies in the first and second energy converters.

* * * * *